US011793292B2

(12) United States Patent
Zheng et al.

(10) Patent No.: US 11,793,292 B2
(45) Date of Patent: Oct. 24, 2023

(54) COSMETIC APPLICATOR

(71) Applicant: APR Beauty Group, Inc., Toronto (CA)

(72) Inventors: Min-Yan Zheng, Toronto (CA); Feng-Ying Fu, Markham (CA)

(73) Assignee: APR Beauty Group, Inc., Toronto (CA)

( * ) Notice: Subject to any disclaimer, the term of this patent is extended or adjusted under 35 U.S.C. 154(b) by 311 days.

(21) Appl. No.: 17/158,907

(22) Filed: Jan. 26, 2021

(65) Prior Publication Data

US 2021/0315361 A1 Oct. 14, 2021

(30) Foreign Application Priority Data

Apr. 13, 2020 (IN) ..... 202011015874

(51) Int. Cl.
*A46B 5/02* (2006.01)
*A45D 34/04* (2006.01)
*A45D 40/26* (2006.01)

(52) U.S. Cl.
CPC ..... *A45D 34/045* (2013.01); *A45D 40/265* (2013.01); *A46B 5/02* (2013.01); *A46B 2200/106* (2013.01)

(58) Field of Classification Search
CPC .... A45D 34/00; A45D 34/042; A45D 34/045; A45D 33/00; A45D 33/36; A45D 33/02; A45D 40/00; A45D 40/262; A45D 40/264; A45D 40/265; A45D 40/267; A45D 40/268; A46B 2200/106; A46B 2200/1018; A46B 2200/1009; A46B 2200/1072; A46B 2200/109; A46B 2200/1081; A46B 5/02
USPC ..... 15/144.1
See application file for complete search history.

(56) References Cited

U.S. PATENT DOCUMENTS

| | | | | |
|---|---|---|---|---|
| 9,827,589 | B2 | 11/2017 | Daviot et al. | |
| 10,314,380 | B2 * | 6/2019 | Schreiber | A46B 9/021 |
| 10,575,621 | B1 * | 3/2020 | Pires | A45D 19/0066 |
| 2007/0181143 | A1 | 8/2007 | Montoli | |
| 2010/0269842 | A1 * | 10/2010 | Gueret | A46B 9/021 132/218 |
| 2012/0204899 | A1 * | 8/2012 | Uehara | A45D 40/267 132/320 |
| 2019/0125058 | A1 * | 5/2019 | Cavazzuti | A61Q 1/04 |
| 2020/0237074 | A1 * | 7/2020 | Gauttier | A45D 34/04 |
| 2020/0323327 | A1 * | 10/2020 | Bose | A45D 34/046 |
| 2020/0329847 | A1 * | 10/2020 | Bianco | A45D 34/043 |
| 2021/0076799 | A1 * | 3/2021 | Seo | A45D 40/264 |

* cited by examiner

*Primary Examiner* — Cris L. Rodriguez
*Assistant Examiner* — Karim Asqiriba
(74) *Attorney, Agent, or Firm* — Jason L. DeFrancesco

(57) ABSTRACT

A cosmetic applicator for applying a product including a cosmetic, care, or pharmaceutical product onto the keratinous substrate. The cosmetic applicator comprises an applicator head and wherein the applicator head further comprises an applying member. The applying member includes at least one main face which is bounded by two opposing lateral edges. At least a portion of the one of the at least two lateral edges includes at least four parallel incisions which make a non-zero angle with a central longitudinal axis of the cosmetic applicator. The at least four parallel incisions form at least three parallel applicator tabs on the applying member.

15 Claims, 8 Drawing Sheets

COSMETIC APPLICATOR

This application claims priority under 35 U.S.C. § 119 to Indian Provisional Patent Application No. 202011015874, filed on Apr. 13, 2020, which is incorporated herein by reference.

BACKGROUND

Field

The present disclosure generally relates to a cosmetic applicator for applying a product including a cosmetic, care, or pharmaceutical product, onto keratinous substrate such as skin, lips, under eyes, eyelids, cheeks, nails or any other part of the body.

Description of the Related Art

Many cosmetic products that are flowable or otherwise non-self-sustaining in shape, are packaged and sold in a container which holds the cosmetic product and the cosmetic product is transported and applied from the container to a user's skin by a cosmetic applicator. Commonly, the cosmetic applicator is provided at the end of a stem carried by a cap which seats on and closes the mouth or opening of the container, the cosmetic applicator being immersed in the cosmetic material contained in the container when the cap is in the container-closing position. The cap serves as a handle for the user when the cosmetic applicator, bearing a quantity of the cosmetic product, is withdrawn from the container and applied to the skin.

In some instances, a flexible elastomeric wiper is mounted in the container opening so as to engage the cosmetic applicator as the cosmetic applicator is withdrawn through the opening, for removing excess cosmetic product that may be carried by the cosmetic applicator from the body of cosmetic product within the container.

Applicators for cosmetics or other substances, such as drugs, are known in various designs and forms. For example, reference is made to the U.S. Pat. No. 6,070,598, the U.S. Pat. No. 6,220,254 and the U.S. Pat. No. 5,123,431.

Not all known applicators are suitable and designed to apply cosmetic products comparatively over a large area and at the same time gently, for example, to the skin.

Thus there is a need for a cosmetic applicator which enables a gentle application while covering a large area during application.

SUMMARY

It is an object of the present disclosure to provide a cosmetic package that can be easily configured to contain a product and a cosmetic applicator.

It is an object of the present disclosure to provide a cosmetic applicator that enables a gentle application while covering a large area during application.

It is yet another object of the present disclosure to provide a cosmetic applicator that offers a comparatively large surface area, very simple to use, economical to manufacture, and aesthetically pleasing.

Further, a cosmetic applicator is desired which is comfortable and easier to use.

Accordingly, there is provided a cosmetic applicator having an applicator head, and wherein the applicator head comprises an applying member. The applying member includes two opposing main faces which are bounded by two lateral edges. Further, at least a portion of one of the two lateral edges of the applying member is discontinuous because of incisions. More particularly, the applying member includes at least four parallel incisions that extend from one of the two lateral edges in a direction towards a central longitudinal axis of the cosmetic applicator such that the at least four parallel incisions make a non-zero angle with the central longitudinal axis of the cosmetic applicator. The at least three parallel applicator tabs are formed by at least four parallel incisions on the applying member.

According to an aspect of the present disclosure, a cosmetic package for applying a product including a cosmetic, care, or pharmaceutical product onto the keratinous substrate comprises a receptacle and the cosmetic applicator. The receptacle is configured to contain a product including a cosmetic, care, or pharmaceutical product. However, in alternate embodiments, the receptacle may include a separate inner reservoir to hold a volume of the product to be dispensed. The cosmetic, care, or pharmaceutical product includes viscous cosmetics, mascara, eyebrow powder, lip gloss, hair color, cheek blush, skin care, under eye cosmetics, pharmaceutical, and like products.

According to yet another aspect of the present disclosure, the cosmetic applicator comprises the applicator head, a stem, and a cap. The cap of the cosmetic applicator has threads that can be screwed onto threads, formed on a neck of the receptacle. The applicator head is retained at a distal end of the stem for applying the product; and the cap at a proximal end of the stem.

In general, the use of the terms "distal" and "proximal" herein is supposed to mean that the distal side/end is the side/end facing towards the inside of the storage receptacle, whereas the proximal side/end is the side/end facing towards the removal opening of the receptacle.

Further, the distal end of the stem includes an interior longitudinal cavity for receiving and retaining the applicator head.

Inserted in the neck of the receptacle is a wiper for wiping off excess product from the cosmetic applicator.

Further, the applicator head of the cosmetic applicator may be used to apply the product including a cosmetic or care product. The cosmetic or care product includes viscous cosmetics, mascara, eyebrow powder, lip gloss, hair color, skin care, under eye cosmetics, pharmaceutical, and like products.

According to an aspect of the present disclosure, the applicator head comprises the applying member at its distal portion and a shank member at its proximal portion. The shank member is configured to be received and retained within the longitudinal cavity of the stem.

In the present embodiment, the shank member and the applying member are integral, however in alternate embodiments that may be two separate parts. The applying member is designed to apply the product to a target surface.

According to an aspect of the present disclosure, the applying member is elongated along a central longitudinal axis of the cosmetic applicator. The applying member is substantially planar, i.e. its width is greater than its thickness, more particularly, the width of the applying member is at least two times the thickness of the applying member.

The applying member is elongated, that is to say, its extent in a direction parallel to the longitudinal axis is larger than its largest extension perpendicularly to the longitudinal axis. Particularly, the largest extension of the applying member in the direction parallel to the longitudinal axis by at least a factor of 1.5, more preferably is greater by at least a factor of 2 than the greatest extension of the applying member in a direction perpendicular to the longitudinal axis.

Further, the applying member includes two opposing main faces, namely a first face and an opposing second face. The first face and the second face of the applying member are bounded by two opposing lateral edges namely a left side edge and a right side edge. The applying member further includes a proximal end and a distal end.

According to the first embodiment of the present disclosure, the left side edge and the right side edge are both convexly curved along the longitudinal axis of the cosmetic applicator. More particularly, in a right side view of the applying member, the right side edge has a shape which towards the distal end of the applying member is convexly curved and thus the right side edge of the applying member provides a narrow blending surface to line and blend a cosmetic product, for example, at corners of lip and eyes.

In alternate embodiments, the curves of the left and right lateral edges and a shape of the applying member may be different, and thus the disclosure is not limited by the curves of the left and right lateral edges and the shape of the applying member.

Further, at least a portion of the left side edge of the applying member is discontinuous because of incisions. More particularly, the applying member includes at least four parallel incisions that extend from the left side edge in a direction towards the central longitudinal axis of the cosmetic applicator such that the at least four parallel incisions make a non-zero angle with the central longitudinal axis of the cosmetic applicator. The non-zero angle is an angle other than an orthogonal angle. The at least three parallel applicator tabs are formed by at least four parallel incisions on the applying member. More particularly, the at least four parallel incisions form at least three parallel applicator tabs on a peripheral portion of the applying member maj orly located on the left of the central longitudinal axis on the first main face. The at least three parallel applicator tabs also make the non-zero angle with the central longitudinal axis of the cosmetic applicator.

Each of the at least three parallel applicator tabs includes a free end extending away from the central longitudinal axis of the cosmetic applicator.

In the present embodiment, the at least four parallel incisions are perpendicular to the outer surfaces of the first main face and the second main face. According to an aspect of the present disclosure, the at least three parallel applicator tabs are uniformly spaced and are separated by the at least four parallel incisions. Further, each of the at least three parallel applicator tabs is formed by two of the at least four parallel incisions in the applying member.

According to alternate embodiments, the at least four parallel incisions and/or the at least three parallel applicator tabs may not be uniformly spaced apart.

According to an aspect of the present disclosure, the at least three parallel applicator tabs may be bendable and their bendability depends on their stiffness or elasticity in particular by the material used, depths of the at least four parallel incisions, and the thickness of the applying member. In particular, the bendability and the elasticity can be adjusted in such a way that sufficient application of the product can be achieved.

According to yet another aspect of the present disclosure, through the at least four parallel incisions, a kind of reservoir for the product may be provided in the applying member. The reservoir can be of the shape of the at least four parallel incisions and can store sufficient amount of the product, which when using the applying member can significantly reduce the frequency of rewetting the applying member.

Each of the at least four parallel incisions has the depth and wherein depth of at least one of each of the at least four parallel incisions is different from the rest of the at least four parallel incisions. In alternate embodiments, the depths of all of the at least four parallel incisions may be the same or different from one another.

According to yet another aspect of the present disclosure, the depth of the at least four parallel incisions lies in the range of 1 mm-3 mm.

According to yet another aspect of the present disclosure, each of the at least four parallel incisions has an incision opening which has a width that remains substantially constant throughout its depth.

In an embodiment, the width of the incision openings of all of the at least four parallel incisions are equal, and wherein each one has constant width. Particularly, the at least four parallel incisions are of same width and wherein the width of the at least four parallel incisions may be selected from a range of 0.1 mm-3 mm. However, in alternate embodiments, the width of the incision opening of the at least one of each of the at least four incision openings is different from the rest of the at least four incision openings. In yet alternate embodiments, the widths of all of the at least four parallel incision openings may be the same or different from one another.

In an exemplary embodiment, the width of each of the at least three parallel applicator tabs is essentially the same. In the context of the disclosure, however, it is also possible, the width of each of the at least three parallel applicator tabs may vary if necessary, for example, to obtain suitable or desired application properties.

According to an aspect of the present disclosure, the width of each of the at least three parallel applicator tabs is at least two times greater than the width of the incision opening of each of the at least four parallel incisions.

It can be seen that the thickness of the applying member in a direction perpendicular to the first main face and/or the second main face from the proximal end towards the distal end of the applying member initially decreases, and then remains substantially constant. Variation in the thickness of the applying member may possibly be beneficial as a variety of the applicator tabs are available.

The thickness of the applying member may or may not vary from the right side edge to the left side edge. More particularly, the right side edge is thicker than the left side edge.

According to an aspect of the present disclosure, a width of the applying member and/or the first face/the second face, when seen from the proximal end of the applying member, first increases and reaches a maximum and then continuously decreases towards from the maximum to the distal end of the applying member. A narrow tip is formed at the distal end of the applying member which coincides with the distal end of the applying member. Further, the narrow tip at the distal end allows the user to draw precision lines during application. Further, the narrow tip at the distal end of the applying member may not coincide with the longitudinal axis of the applying member. More particularly, the narrow tip is off-centered with respect to the central longitudinal axis of the cosmetic applicator.

According to an embodiment of the present disclosure, an outer surface of the applying member is covered with an application element which in this case is flocked fibers. Briefly, the fibers for flocking which may be of any commonly used material, such as nylon, polyester or any natural fiber are applied with an adhesive, such as an epoxy, to the surface to be flocked. The flocking finish to the outer surface of the applying member may be achieved by an appropriately chosen known technique, such as electrostatic flocking.

According to an alternate embodiment of the present disclosure, the applying member may or may not be flocked or partially flocked.

In the present example, the applying member is made of a flexible material, in particular plastic material. More particularly, the applying member is made of an elastomer, in particular of a thermoplastic elastomer.

According to an aspect of the present disclosure, when applying the product, a pressure may be transferred to the at least three parallel applicator tabs of the applying member which may cause a spread of the at least three applicator tabs and the at least three applicator tabs thus can adapt in shape to the background of the target area, providing a soft feel.

The proposed applying member allows flexible adaptation to different requirements and conditions, in particular without extensive adjustments of the manufacturing process for the applying member.

According to another aspect of the present disclosure, the first face and the opposing second face may also have different surface properties, in particular application properties.

According to an aspect of the present disclosure, variants of the applying member are described further, whereby differences between individual variants are mainly discussed.

According to another aspect of the present disclosure, the applying member according to a second embodiment of the present disclosure is different from the applying member of the first embodiment as it comprises at least four parallel incisions on a right side edge of the applying member instead of being present on a left side edge. Further, unlike the applying member of the first embodiment where the at least four parallel incisions are uniformly present on a complete length of the left side edge of the applying member, here in this embodiment, the at least four parallel incisions are located only on less than half a length of the right side edge of the applying member. Further, the left side edge of the applying member is substantially rectilinear, and the right side edge is concavely curved at its proximal portion followed by a convexly curved portion at its distal end portion. Further, the at least four parallel incisions of the applying member are present on the convexly curved distal end portion of the right side edge.

According to yet another aspect of the present disclosure, the applying member according to a third embodiment of the present disclosure is different from the applying member of the first embodiment and the second embodiment as it comprises at least four parallel incisions on each of a right side edge and a left side edge of the applying member instead of being present only on one side edge of the applying members mentioned in above embodiments. The applying member has the at least four parallel incisions on each side of a central longitudinal axis of the applying member. In the embodiment shown, the at least four parallel incisions on the right side edge has a mirror symmetry with the at least four parallel incisions on the left side edge with respect to the central longitudinal axis of the applying member, in particular with regard to position, shape and size. At least three applicator tabs on the right side edge have a mirror symmetry with the at least three applicator tabs on the left side edge with respect to the central longitudinal axis of the applying member.

According to yet another aspect of the present disclosure, the applying member is different from the applying member, the applying member, the applying member of the first embodiment, the second embodiment, and the third embodiment respectively as the applying member has at least one orifice designed to dispense the cosmetic product and wherein an applicator head that comprises the applying member is configured to be mounted on a cosmetic container. The applying member is convexly curved in shape. Further, the applicator head comprises a product delivery passageway that terminates in the orifice on an application face of the applying member. The orifice is positioned at an axis parallel to a central longitudinal axis X of the applicator head for dispensing the product, wherein the orifice is off-centered with respect to the central longitudinal axis X and is positioned towards a distal end of the applicator head.

The application face of the applying member makes a non-zero angle $\alpha$ with central longitudinal axis X of the applicator head. This design facilitates the application of the product to the user's skin. In various implementations, the angle $\alpha$ may be between about 20° and about 75°. Still, further implementations may have angles anywhere from 5° to 90°.

The applicator head includes a shank member which connects the applying member to the cosmetic container. The shank member of the applicator head may be secured to the cosmetic container by, for example, a press-fit, snap-fit, adhesive, and/or engagement by one or more engagement features. The shank member of the applicator head is retained in reservoir employing a fitment known in the art e.g. Snap-connection, screw connection, or any other suitable connection between the outer surface of the shank member and the inner surface of the cosmetic container.

The applicator head is aligned on a cosmetic container such that height of the distal end of the applying member is positioned equal to or greater than height of a proximal end of the applying member for aligning the application face perfectly onto skin of a user. The proximal end is protuberant and the distal end is tapered offering a larger surface area for applying and blending the product and a narrower surface area towards the distal end for précised application of the product for example at corners of lips and eyes.

Further, the application face of the applying member is bounded by two lateral edges, namely a left side lateral edge and a right side lateral edge. According to an aspect of the present disclosure, at least one side edge of the two lateral edges has a greater arc as compared to the other side edge and is discontinuous because of incisions on it. More particularly, the left side edge of the applying member has a greater arc than the right side edge of the applying member. Further, the applying member has incisions both on the left side edge and the right side edge. Preferably, the left side edge has more number of incisions as compared to the right side edge for uniform product blending. The incisions are located at least on a portion proximate to the distal end of the applying member and in close proximity to the orifice in order to evenly distribute the dispensed product across the length of the applying member. The incisions present on the lateral edges provide a sensorial effect during application of the product.

The applying member has at least four parallel incisions on the left side edge and at least two parallel incisions on the right side edge. At least three tabs are formed on the left side edge of the applying member and at least two tabs are formed on the right side edge of the applying member with respect to the central longitudinal axis X of the applicator head.

In alternate embodiments, the number of parallel incisions on the left side and the right side may be equal or interchanged based on the angle of displacement of the applicator head from the central longitudinal axis.

In alternate embodiments, the at least four parallel incisions on the left side edge may not be mirror symmetric to the at least four parallel incisions on the right side edge of the applying member.

In alternate embodiments, the at least three applicator tabs on the left side edge may not be mirror symmetric to the at least three applicator tabs on the right side edge of the applying member.

In certain embodiments, one of the left and right side edges have at least four parallel incisions and the other of the left and right side edges comprises no incision or incisions that may or may not be parallel to one another.

In general, in other variants and configurations of the applying members already mentioned herein, may have rectilinear, double convex, half convex, half concave, double concave and concave convex side edges or any other shape possible.

All variants and configurations of the applying member can be manufactured essentially with the same manufacturing process. The proposed applying member can be produced in a simple manner, for example, in an injection molding process. The introduction of the incisions after preparation of the applying member using a cutting element or cutting tool can be performed comparatively easily and with little manufacturing effort.

Optionally, the manufacturing process may further comprise a flocking step provided that the applying member at least in part, to be flocked with a flocking material. The flocking preferably takes place before the incisions are made.

According to an embodiment of the present disclosure, at least a part and preferably all of the applicator head can be made by molding, e.g. by injection-molding, e.g. in a material selected from the following list: thermoplastic materials; elastomers; thermoplastic elastomers; thermoplastic elastomer polyester such as HYTREL®, for example; nitrile rubber; silicone rubber; ethylene-propylene terpolymer rubber (EPDM); styrene-ethylene-butylene-styrene (SEBS); styrene-isoprene-styrene (SIS); polyurethane (PU); ethyl vinyl acetate (EVA); polyvinyl chloride (PVC); polyethylene (PE); polyethylene terephthalate (PET); polypropylene (PP); this list not being limiting.

The wiper serves to wipe off not only the excess cosmetic product attached to the applying member but also the cosmetic product attached to the stem.

According to an embodiment, the receptacle and the cap may be made of a rigid material like glass, metal, hard plastic or any other material known in the art. However, in alternate embodiments, the receptacle and the cap may be made of a flexible material like flexible polymeric material or any other material known in the art.

According to an embodiment of the present disclosure, the stem presents a cross-section that is circular, but it is not beyond the ambit of the present disclosure for this to be otherwise, in particular when the cross-section of the stem is oval, elliptical or polygonal, e.g. square, triangular or rectangular. The stem can be solid as shown, or, in a variant, it could be hollow.

When the stem is not of circular cross-section, the cap can possibly be fastened on the receptacle by snap-fastening or by some other means, without turning relative to said receptacle. The wiper can thus present a non-circular wiper orifice of section that is complementary to the section of the stem.

According to an embodiment of the present disclosure, the applicator head can be made, at least in part, from a material that is more flexible than a material from which the stem is made.

According to an embodiment of the present disclosure, the applicator head and the stem are fitted together by a snap fitment. However, in alternate embodiments, the applicator head and the stem may be fit together by friction fit, by gluing, crimping, magnetic engagement and the like.

According to an embodiment of the present disclosure, the stem can have a longitudinal axis that is rectilinear as shown. However, in alternate embodiments, it could be curved.

The present disclosure is not limited to, the broadest in accordance with the basic idea disclosed herein. It should be interpreted as having a range. Skilled artisans may implement the pattern of the non-timely manner by combining, replacement of the disclosed embodiments shape, this would also do not depart from the scope of the invention. In addition, those skilled in the art may readily change or modifications to the disclosed embodiments, based on the present specification, such changes or modifications also belong to the scope of the present disclosure will be apparent.

BRIEF DESCRIPTION OF THE DRAWINGS

A more complete appreciation of the present disclosure and many of the attendant advantages thereof will be readily obtained as the same becomes better understood by reference to the following detailed description when considered in connection with the accompanying drawings, wherein.

DETAILED DESCRIPTION

Figure 1:
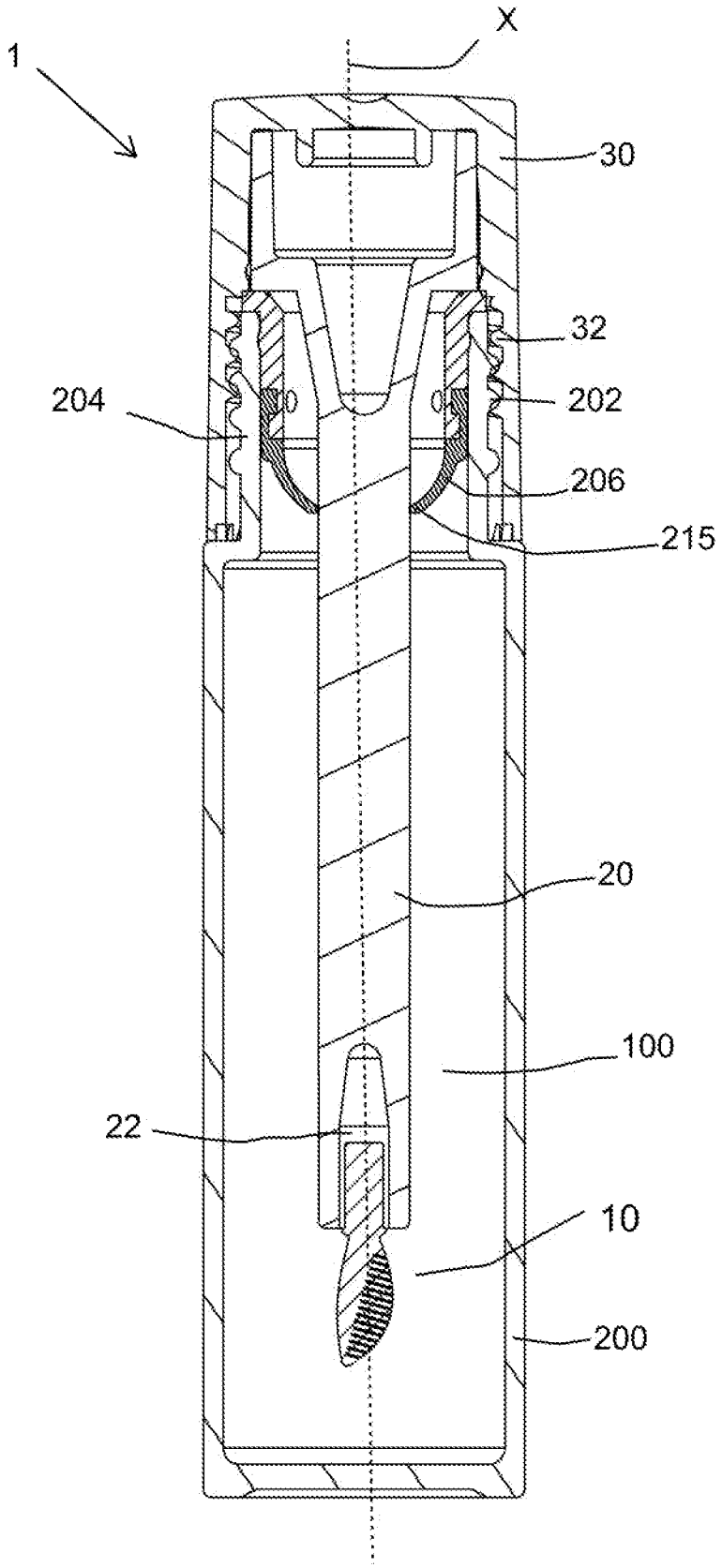
FIG. 1 illustrates a cross sectional view of a cosmetic package equipped with a cosmetic applicator according to a first embodiment of the present disclosure.
Figure 2:
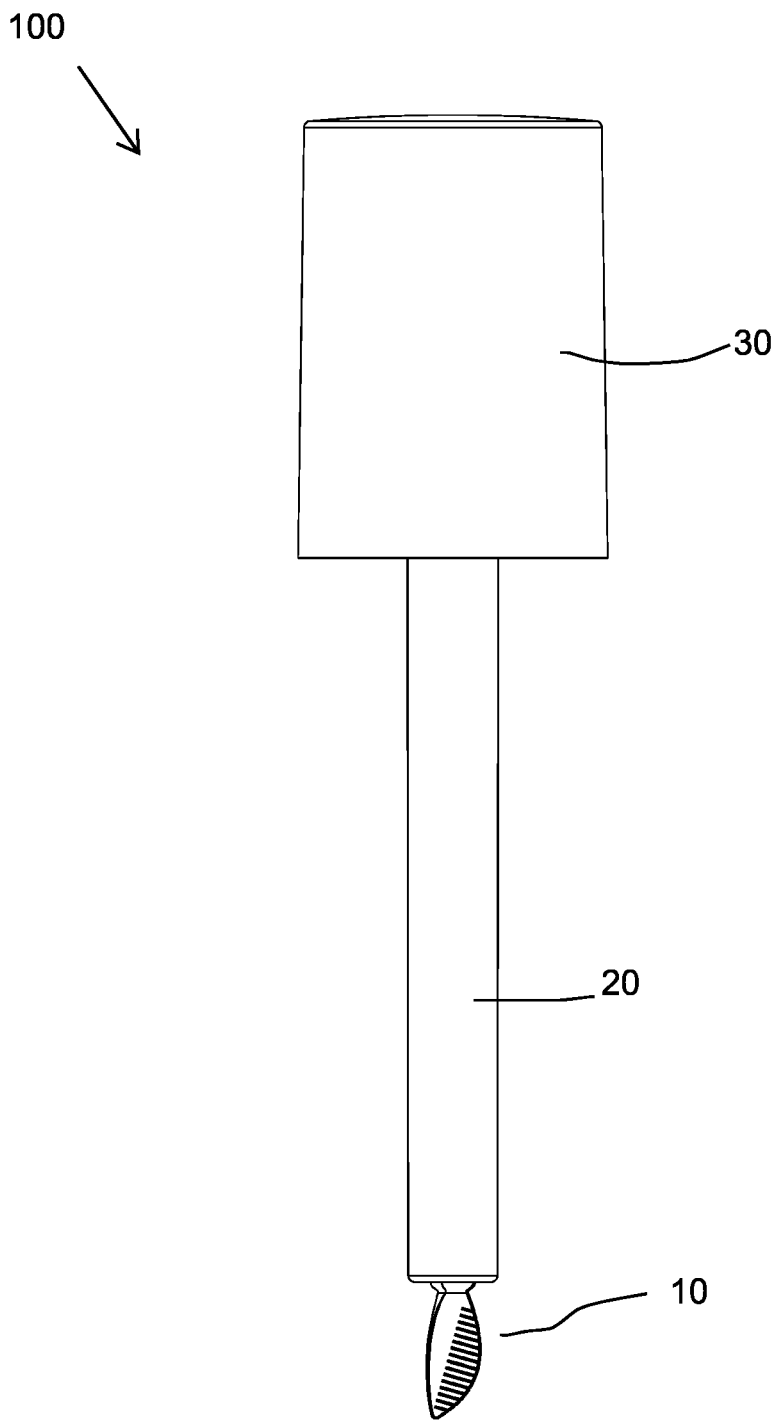
FIG. 2 illustrates a front view of the cosmetic applicator of the cosmetic package of FIG. 1.

As shown throughout the drawings, like reference numerals designate like or corresponding parts. While illustrative embodiments of the present disclosure have been described and illustrated above, it should be understood that these are exemplary of the disclosure and are not to be considered as limiting. Additions, deletions, substitutions, and other modifications can be made without departing from the spirit or scope of the present disclosure. Accordingly, the present disclosure is not to be considered as limited by the foregoing description.

Throughout this specification, the terms "comprise," "comprises," "comprising" and the like, shall consistently mean that a collection of objects is not limited to those objects specifically recited.

FIG. 1 illustrates a longitudinal sectional view of a cosmetic package 1. The cosmetic package 1 comprises a receptacle 200 for holding a product (not shown) and a cosmetic applicator 100. The cosmetic applicator 100 comprises an applicator head 10, a stem 20, and a cap 30. The cap 30 of the cosmetic applicator 100 has threads 32 that can be screwed onto threads 202, formed on a neck 204 of the receptacle 200. The applicator head 10 retained at a distal end of the stem 20 for applying the product; and the cap 30 at a proximal end of the stem 20.

In general, the use of the terms "distal" and "proximal" herein is supposed to mean that the distal side/end is the side/end facing towards the inside of the storage receptacle 200, whereas the proximal side/end is the side/end facing towards the removal opening of the receptacle 200.

Further, the distal end of the stem 20 includes an interior longitudinal cavity 22 for receiving and retaining the applicator head 10.

Inserted in the neck 204 of the receptacle 200 is a wiper 206 for wiping off excess product from the cosmetic applicator 100.

Further, the applicator head 10 of cosmetic applicator 100 may be used to apply the product including a cosmetic or care product. The cosmetic or care product includes viscous cosmetics, mascara, eyebrow powder, lip gloss, hair color, skin care, under eye cosmetics, pharmaceutical, and like products.

Figure 3:
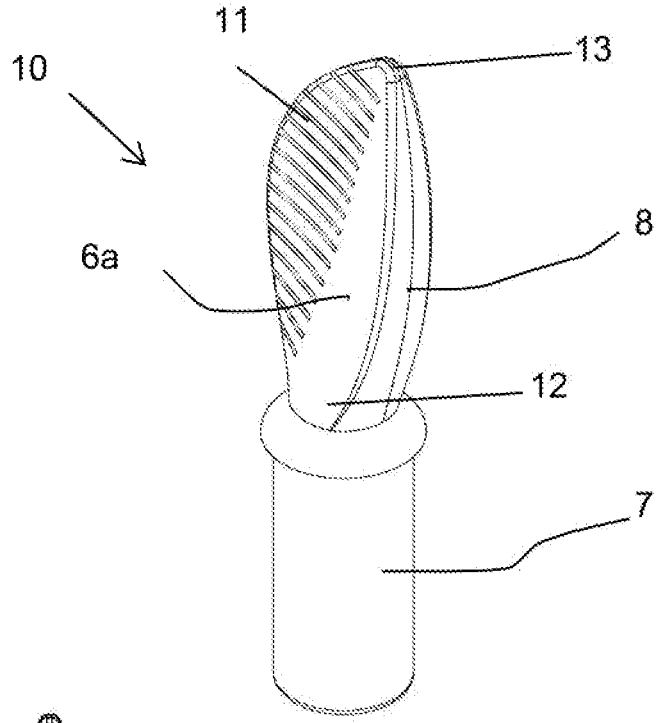
FIG. 3 illustrates a perspective view of an applicator head of the cosmetic applicator of FIG. 2.
Figure 4:
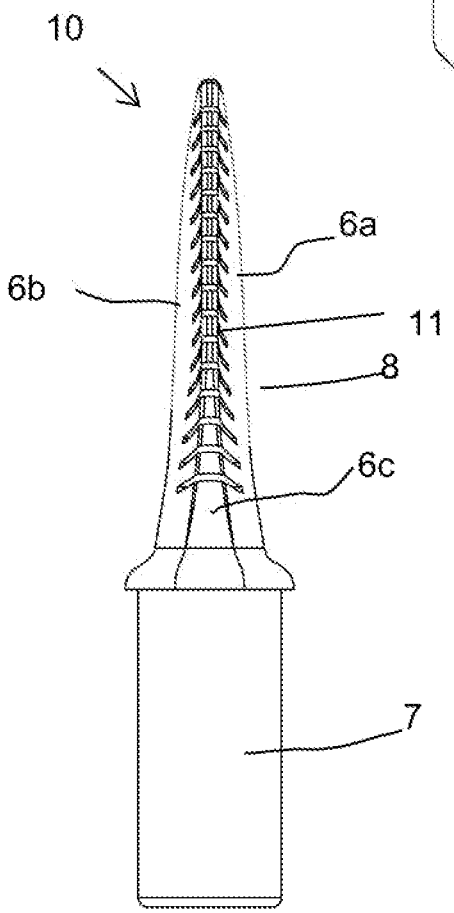
FIG. 4 illustrates a left side view of the applicator head of FIG. 3.
Figure 5:
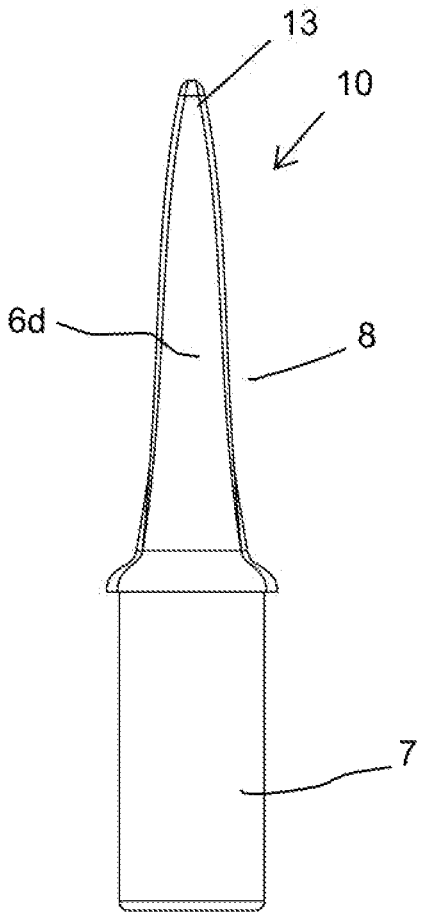
FIG. 5 illustrates a right side view of the applicator head of FIG. 3.
Figure 6:
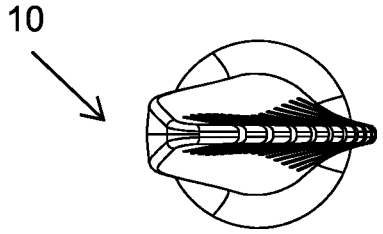
FIG. 6 illustrates a top view of the applicator head of FIG. 3.

As shown in FIGS. 3-5, the applicator head 10 comprises an applying member 8 at its distal portion and a shank member 7 at its proximal portion. The shank member 7 is configured to be received and retained within the longitudinal cavity 22 of the stem 20 (see FIG. 1).

In the present embodiment, the shank member 7 and the applying member 8 are integral, however in alternate embodiments that may be two separate parts. The applying member 8 is designed to apply the product to a target surface.

The applicator head 10 and the applying member 8 are elongated along a central longitudinal axis X of the cosmetic applicator 100 (refer FIG. 1). The applying member 8 is substantially planar, i.e. its width is greater than its thickness. More particularly, the width of the applying member 8 is at least two times the thickness of the applying member 8.

The applying member 8 is elongated, that is to say, its extent in a direction parallel to the longitudinal axis X is larger than its largest extension perpendicularly to the longitudinal axis X. Particularly, the largest extension of the applying member 8 in the direction parallel to the longitudinal axis X by at least a factor of 1.5, more preferably is greater by at least a factor of 2 than the greatest extension of the applying member 8 in a direction perpendicular to the longitudinal axis X.

Referring FIGS. 3-8, the applying member 8 includes two opposing main faces, namely a first face 6*a* and an opposing second face 6*b*. The first face 6*a* and the second face 6*b* of the applying member 8 are bounded by two opposing lateral edges namely a left side edge 6*c* and a right side edge 6*d*. The applying member 8 further includes a proximal end 12 and a distal end 13.

Figure 8:
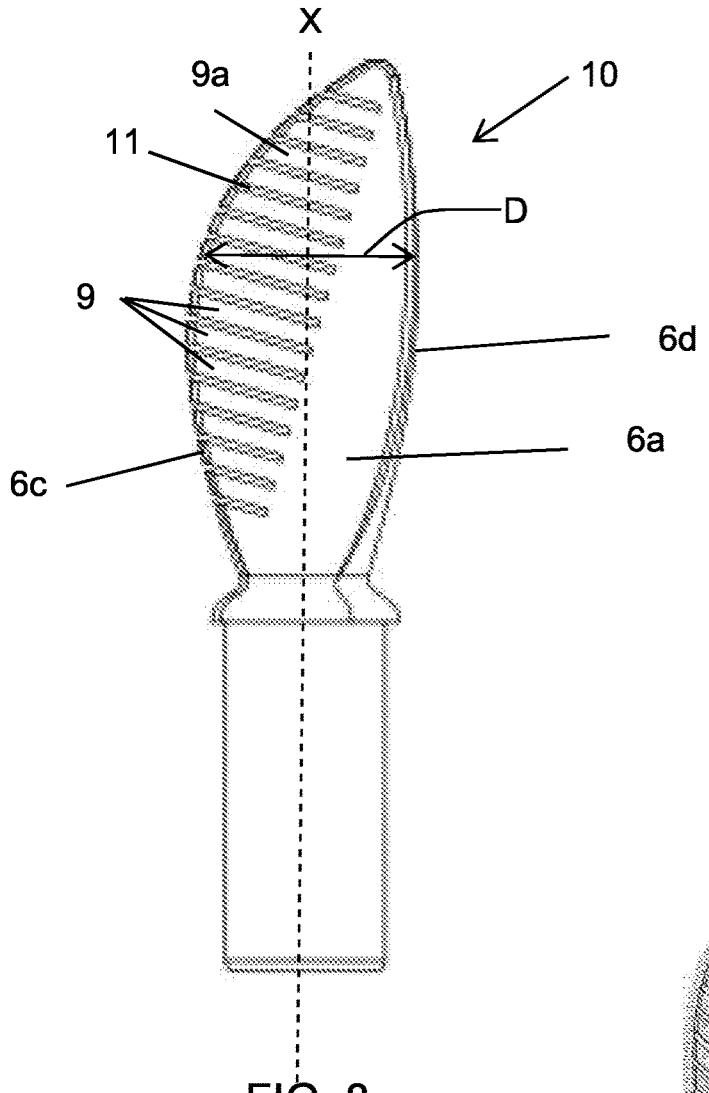
FIG. 8 illustrates a front view of the applicator head of FIG. 3.

According to the first embodiment of the present disclosure, as shown in FIG. 8, both the left side edge 6*c* and the right side edge 6*d* are convexly curved along the longitudinal axis X of the cosmetic applicator 100. More particularly, in a right side view of the applying member 8 as shown in FIGS. 5 and 8, the right side edge 6*d* has a shape which towards the distal end 13 of the applying member 8 is convexly curved and thus the right side edge 6*d* of the applying member 8 provides a narrow blending surface to line and blend a cosmetic product for example at corners of lip and eyes.

In alternate embodiments, the curves of the left and right lateral edges 6*c* and 6*d* and a shape of the applying member 8 may be different, and thus the disclosure is not limited by the curves of the left and right lateral edges 6*c* and 6*d* and the shape of the applying member 8.

Further as shown in FIG. 8, at least a portion of the left side edge 6*c* of the applying member 8 is discontinuous because of incisions 11. More particularly, the applying member 8 includes at least four parallel incisions 11 that extend from the left side edge 6*c* in a direction towards the central longitudinal axis X of the cosmetic applicator 100 such that the at least four parallel incisions 11 make a non-zero angle with the central longitudinal axis X of the cosmetic applicator 100. It is preferred that the non-zero angle is an angle other than an orthogonal angle. The at least three parallel applicator tabs 9 are formed on the applying member 8 by at least four parallel incisions 11. More particularly, the at least four parallel incisions 11 form at least three parallel applicator tabs 9 on a peripheral portion of the applying member 8 which are located majorly on the left of the central longitudinal axis X on the first main face 6*a*. The at least three parallel applicator tabs 9 also make the non-zero angle with the central longitudinal axis X of the applying member 8, and thus at least three parallel applicator tabs 9 are inclined with respect to central longitudinal axis X.

Each of the at least three parallel applicator tabs 9 includes a free end 9*a* extending away from the central longitudinal axis X of the applying member 8.

In the present embodiment, the at least four parallel incisions 11 are perpendicular to the outer surfaces of the first main face 6*a* and the second main face 6*b*.

According to an aspect of the present disclosure, the at least three parallel applicator tabs 9 are uniformly spaced and are separated by the at least four parallel incisions 11. Further, each of the at least three parallel applicator tabs 9 is formed by two of the at least four parallel incisions 11 in the applying member 8.

According to alternate embodiments, the at least four parallel incisions 11 and/or the at least three parallel applicator tabs 9 may not be uniformly spaced apart.

According to an aspect of the present disclosure, the at least three parallel applicator tabs 9 may be bendable and their bendability depends on their stiffness or elasticity in particular by the material used, depths of the at least four parallel incisions 11, and the thickness of applying member 8. In particular, the bendability and the elasticity can be adjusted in such a way that sufficient application of the product can be achieved.

According to yet another aspect of the present disclosure, through the at least four parallel incisions 11, a kind of reservoir for the product may be provided in the applying member 8. The reservoir can be of the shape of the at least four parallel incisions 11 and is able to store sufficient amount of the product, which when using the applying member 8 can significantly reduce the frequency of rewetting the applying member 8. In other embodiments, the at least four parallel incisions 11 may have very small thickness which does not forms a significant reservoir in the applying member 8.

Each of the at least four parallel incisions 11 has the depth T and wherein depth T of at least one of each of the at least four parallel incisions 11 is different from the rest of the at least four parallel incisions 11. In alternate embodiments, the depths of all of the at least four parallel incisions 11 may be the same or different from one another.

According to yet another aspect of the present disclosure, the depth T of the at least four parallel incisions 11 lies in the range of 1 mm-3 mm.

According to yet another aspect of the present disclosure, each of the at least four parallel incisions 11 has an incision opening 11*a* which has a width W that remains substantially constant throughout its depth T.

In the present embodiment, the width W of the incision openings 11*a* of all of the at least four parallel incisions 11 are equal, and wherein each one has constant width. Particularly, the at least four parallel incisions 11 are of the same width, and wherein the width of the at least four parallel incisions 11 may be selected from a range of 0.1 mm-3 mm. However, in alternate embodiments, the width W of the incision opening 11*a* of the at least one of each of the at least four incision openings 11*a* is different from the rest of the at least four incision openings 11*a*. In yet alternate embodiments, the widths of all of the at least four parallel incision openings 11*a* may be the same or different from one another.

The width B of each of the at least three parallel applicator tabs 9 in the embodiment shown is essentially the same. In the context of the disclosure, however, it is also possible, the width B of each of the at least three parallel applicator tabs 9 may vary if necessary, for example to obtain suitable or desired application properties.

According to an aspect of the present disclosure, the width B of each of the at least three parallel applicator tabs 9 is at least two times greater than width W of the incision opening 11*a* of each of the at least four parallel incisions 11.

It can be seen that the thickness E of the applying member 8 in a direction perpendicular to the first main face 6*a* and/or the second main face 6*b* from the proximal end 12 towards the distal end 13 of the applying member 8 initially decreases, and then remains substantially constant. Variation in the thickness E of the applying member 8 may possibly be beneficial as a variety of the applicator tabs 9 are available.

The thickness E of the applying member 8 may or may not vary from the right side edge 6*d* to the left side edge 6*c*. More particularly, in the embodiment shown in FIGS. 4 & 5, the right side edge 6*d* is thicker than the left side edge 6*c*.

Figure 7:
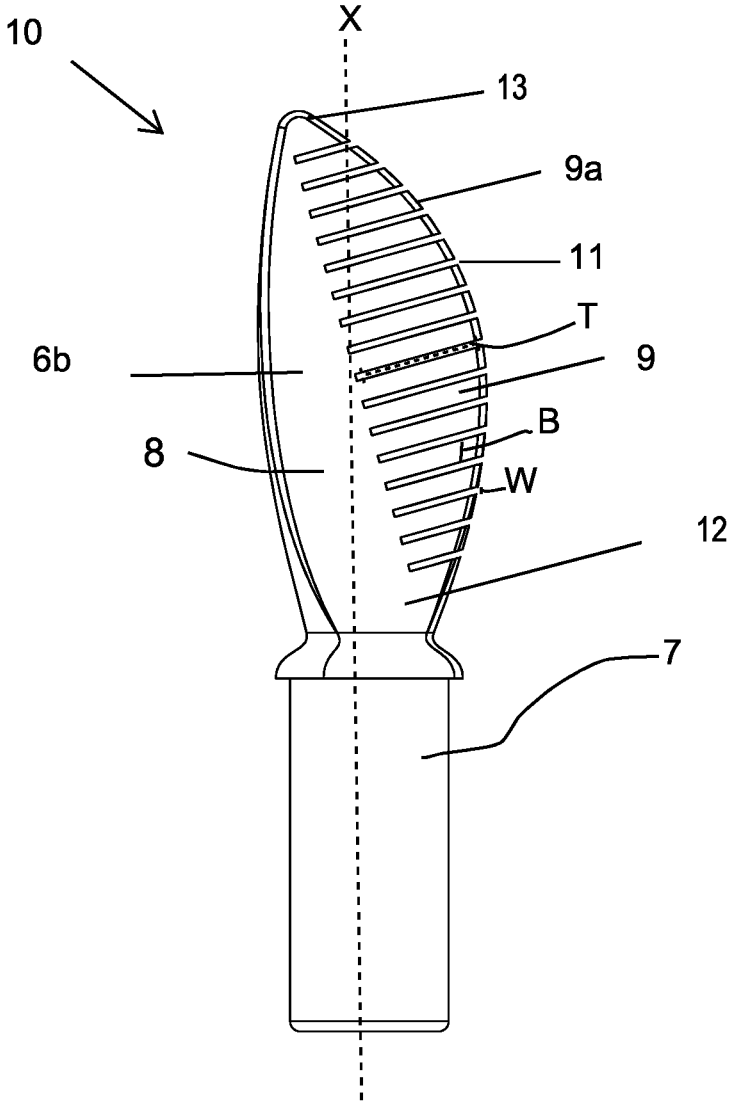
FIG. 7 illustrates a back view of the applicator head of FIG. 3.

A width D of the applying member 8 and/or the first face 6*a*/the second face 6*b*, when seen from the proximal end 12 of the applying member 8, first increases and reaches a maximum and then continuously decreases towards from the maximum to the distal end 13 of the applying member 8, as seen FIGS. 7-8, illustrating a back view and a front view of the applying member 8 respectively. A narrow tip 13 is formed at the distal end 13 of the applying member 8 which coincides with the distal end 13 of the applying member 8. Further, the narrow tip 13 at the distal end 13 allows the user to draw precision lines during application. Further, the narrow tip 13 at the distal end 13 of the applying member 8 may not coincide with the longitudinal axis X of the applying member 8 (refer FIG. 7). More particularly, the narrow tip 13 is off-centered with respect to the central longitudinal axis X of the cosmetic applicator 100.

Figure 9:
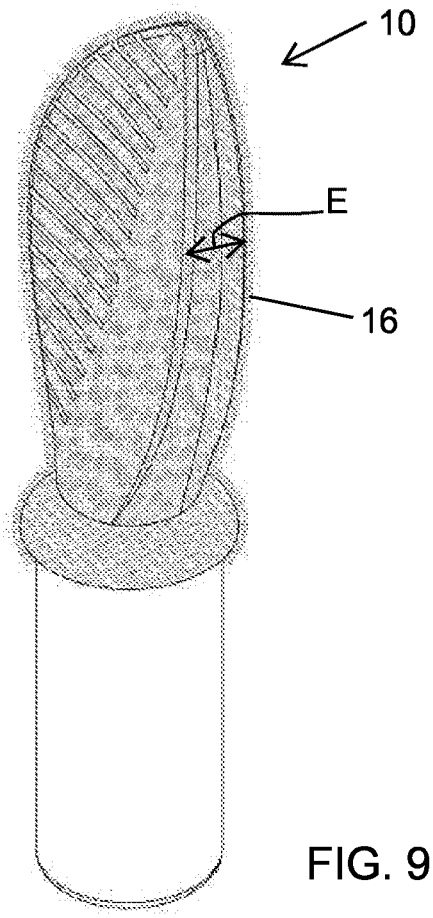
FIG. 9 illustrates a perspective view of the applicator head of FIG. 3 with flocking on an outer surface of an applying member thereof.

According to an embodiment of the present disclosure, an outer surface of the applying member 8 is covered with an application element 16 which in this case is flocked fibers, see FIG. 9. Briefly, the fibers for flocking which may be of any commonly used material, such as nylon, polyester or any natural fiber are applied with an adhesive, such as an epoxy, to the surface to be flocked. The flocking finish to the outer surface of the applying member 8 may be achieved by an appropriately chosen known technique, such as electrostatic flocking.

According to an alternate embodiment of the present disclosure, the applying member 8 may or may not be flocked or partially flocked.

In the present example, the applying member 8 is made of a flexible material, in particular plastic material. More particularly, the applying member 8 is made of an elastomer, in particular of a thermoplastic elastomer.

When applying the product, a pressure may be transferred to the at least three parallel applicator tabs 9 of the applying member 8 which may cause a spread of the at least three applicator tabs 9 and the at least three applicator tabs 9 thus can adapt in shape to the background of the target area, providing a soft feel.

The proposed applying member 8 allows flexible adaptation to different requirements and conditions, in particular without extensive adjustments of the manufacturing process for the applying member 8.

The first face 6*a* and the opposing second face 6*b* of the applying member 8 may also have different surface properties, in particular application properties.

In reference to FIGS. 10-16, variants of the applicator heads 10 are described, whereby differences between individual variants are mainly discussed.

Figure 10:
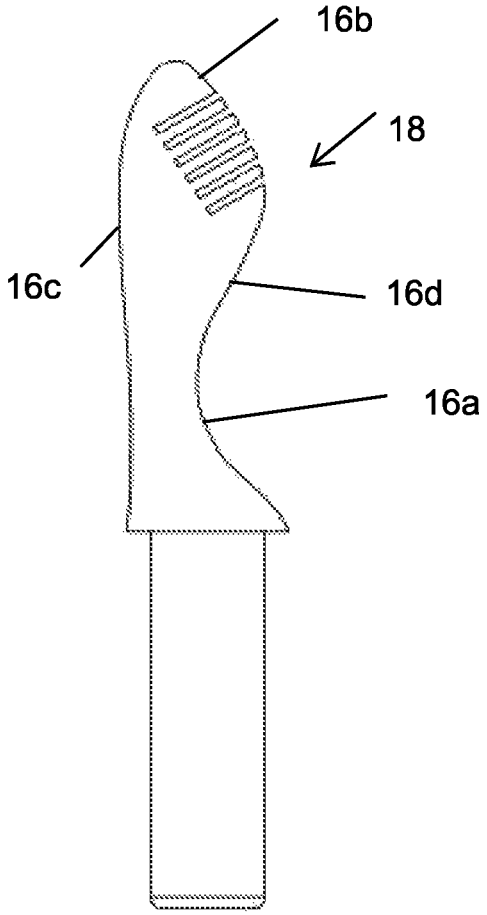
FIG. 10 illustrates a front view of an applicator head according to a second embodiment of the present disclosure.
Figure 11:
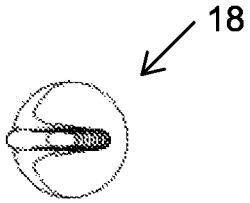
FIG. 11 illustrates a top view of the applicator head of FIG. 10.
Figure 12:
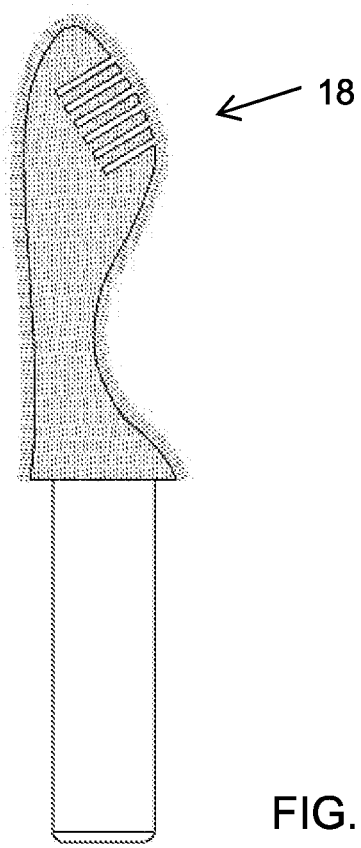
FIG. 12 illustrates a front view of the applicator head of FIG. 10 with flocking on an outer surface of applying member thereof.
Figure 13:
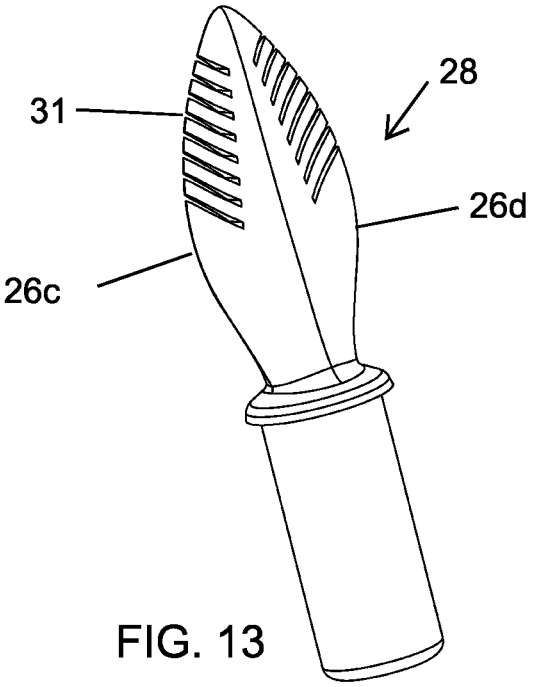
FIG. 13 illustrates a perspective view of an applicator head according to a third embodiment of the present disclosure.
Figure 14:
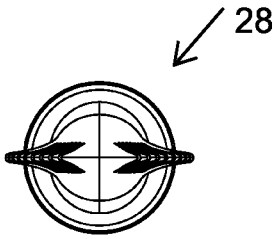
FIG. 14 illustrates a top view of the applicator head of FIG. 13.
Figure 15:
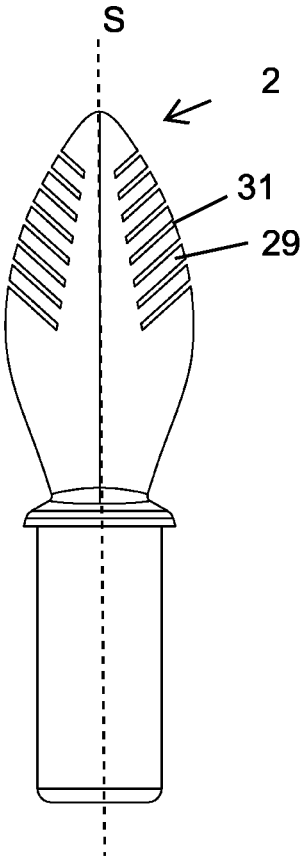
FIG. 15 illustrates a front view of the applicator head of FIG. 13.
Figure 16:
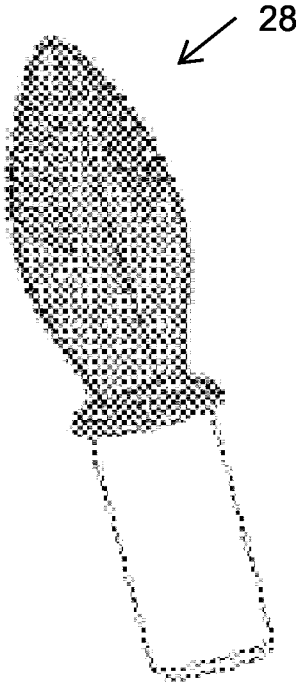
FIG. 16 illustrates a perspective view of the applicator head of FIG. 13 with flocking on an outer surface of applying member thereof.

FIGS. 10-12 show an applicator head with an applying member 18 according to a second embodiment of the present disclosure. The applying member 18 is different from the applying member 8 of the first embodiment as it comprises at least four parallel incisions 21 on a right side edge 16*d* of the applying member 18 instead of being present on a left side edge 16*c*. Further, unlike the applying member 8 of the first embodiment where the at least four parallel incisions 11 are uniformly present on a complete length of the left side edge 6*c* of the applying member 8, here in this embodiment, the at least four parallel incisions 21 are located only on less than half a length of the right side edge 16*d* of the applying member 18. Further, the left side edge 16*c* of the applying member 18 is substantially rectilinear, and the right side edge 16*d* is concavely curved at its proximal portion 16*a* followed by a convexly curved portion at its distal end portion 16*b*. Further, the at least four parallel incisions 21 of the applying member 18 are present on the convexly curved distal end portion 16*b* of the right side edge 16*d*.

FIGS. 13-16 show an applicator head comprising an applying member 28 according to a third embodiment of the present disclosure. The applying member 28 is different from the applying member 8, the applying member 18, of the first embodiment and the second embodiment respectively as it comprises at least four parallel incisions 31 on each of a right side edge 26*d* and a left side edge 26*c* of the applying member 28 instead of being present only on one side edge of the applying member. The applying member 28 has the at least four parallel incisions 31 on each side of a central longitudinal axis S of the applying member 28. In the embodiment shown, the at least four parallel incisions 31 on the right side edge 26*d* has a mirror symmetry with the at least four parallel incisions 31 on the left side edge 26*c* with respect to the central longitudinal axis S of the applying member 28, in particular with regard to position, shape and size. At least three applicator tabs 29 on the right side edge 26*d* has a mirror symmetry with the at least three applicator tabs 29 on the left side edge 26*c* with respect to the central longitudinal axis S of the applying member 28.

In alternate embodiments, the at least four parallel incisions 31 on the left side edge 26*c* may not be mirror symmetric to the at least four parallel incisions 31 on the right side edge 26*d* of the applying member 28.

In alternate embodiments, the at least three applicator tabs 29 on the left side edge 26*c* may not be mirror symmetric to the at least three applicator tabs 29 on the right side edge 26*d* of the applying member 28.

Figure 17:
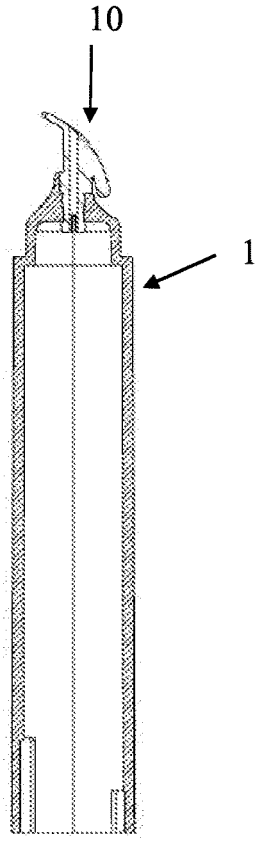
FIG. 17 illustrates a cross sectional view of a cosmetic container equipped with an applicator head according to a fourth embodiment of the present disclosure.
Figure 18:
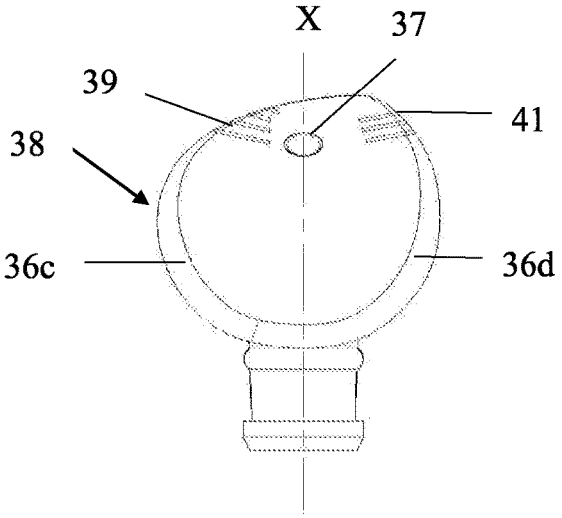
FIG. 18 illustrates a front view of an applicator head of a cosmetic applicator of the cosmetic container of FIG. 17.
Figure 19:
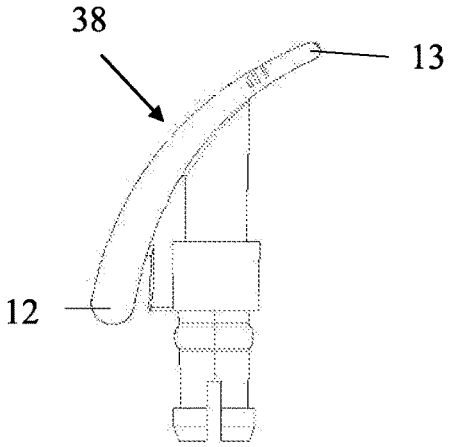
FIG. 19 illustrates a side view of the applicator head of FIG. 18.
Figure 20:
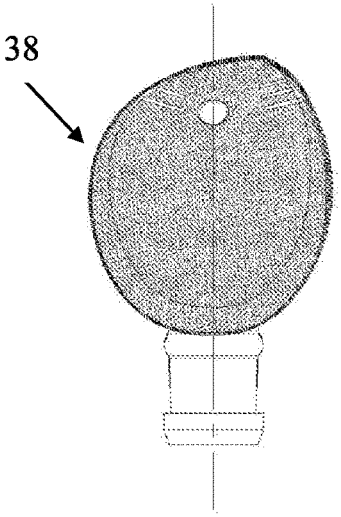
FIG. 20 illustrates a front view of the applicator head of FIG. 18 with flocking on an outer surface of an applying member thereof.

FIGS. 18-20 shows an applying member 38 according to a fourth embodiment of the present disclosure. The applying member 38 is different from the applying member 8, the applying member 18, the applying member 28 of the first embodiment, the second embodiment, and the third embodiment respectively as the applying member 38 has at least one orifice 37 designed to dispense the cosmetic product and wherein an applicator head 10 that comprises the convexly shaped applying member 38 that is configured to be mounted on a cosmetic container 1 as shown in FIG. 17. Further, the applicator head 10 comprises an internal product delivery passageway 39 that terminates in the orifice 37 on an application face 40 of the applying member 38. The at least one orifice 37 is positioned at an axis parallel to a central longitudinal axis X of the applicator head 10 for dispensing the product, wherein the orifice 37 is off-centered with respect to the central longitudinal axis X and is positioned towards a distal end 13 of the applicator head 10.

Further, as shown in FIG., the application face 40 ad the applying member 38 makes a non-zero angle $\alpha$ with central longitudinal axis X of the applicator head 10. This design facilitates the application of the product to the user's skin. In various implementations, the angle $\alpha$ may be between about 20° and about 75°. Still, further implementations, may have angles anywhere from 5° to 90°.

FIG. 17 also illustrates the construction of the applicator head 10. The applicator head 10 includes a shank member 7 which connects the applying member 38 to the cosmetic container 1. The shank member 7 of the applicator head 10 may be secured to the cosmetic container 1 by, for example, a press-fit, snap-fit, adhesive, and/or engagement by one or more engagement features. In the illustrated embodiment, the shank member 7 of the applicator head 10 is retained in reservoir 1 employing a fitment known in the art for e.g. Snap-connection, screw connection, or any other suitable connection between the outer surface of the shank member 7 and the inner surface of the cosmetic container 1.

Referring to FIG. 19, the applicator head 10 is aligned on a reservoir such that height of the distal end 13 of the applying member 38 is positioned equal to or greater than height of a proximal end 12 of the applying member 38 for aligning the application face 40 perfectly onto skin of a user. The proximal end 12 is protuberant and the distal end 13 is tapered offering a larger surface area for applying and blending the product and a narrower surface area towards the distal end 13 for precised application of the product for example at corners of lips and eyes.

Further, the application face 40 of the applying member 38 is bounded by two lateral edges, namely a left side lateral edge 36*c* and a right side lateral edge 36*b*. According to an aspect of the embodiment, at least one side edge of the two lateral edges has a greater arc as compared to the other side edge and is discontinuous because of incisions 41 on it. More particularly, the left side edge 36*c* of the applying member 38 has a greater arc than the right side edge 36*d* of the applying member 38. Further, the applying member 38 has incisions 41 both on the left side edge 36*c* and the right side edge 36*d*. Preferably, the left side edge 36*c* has more number of incisions 41 as compared to the right side edge 36*d* for uniform product blending. The incisions 41 are located at least on a portion proximate to the distal end 13 of the applying member 38 and in close proximity to the orifice 37 in order to evenly distribute the dispensed product across the length of the applying member 38. The incisions 41 present on the lateral edges 36*c*, 36*d* provide a sensorial effect during the application of the product.

As shown in FIG. 18, the applying member 38 has at least four parallel incisions 41 on the left side edge 36*c* and at least two parallel incisions 41 on the right side edge 36*d*. At least three tabs 39 are formed on the left side edge 36*c* of the applying member 38 and at least two tabs 39 are formed on the right side edge 36*d* of the applying member 38 with respect to the central longitudinal axis X of the applicator head 10.

In alternate embodiments, the number of parallel incisions 41 on the left side edge 36*c* and the right side 36*d* may be equal or interchanged based on the angle of displacement of the applicator head 10 from the central longitudinal axis X.

In certain embodiments, one of the left and right side edges have at least four parallel incisions and the other of the left and right side edges comprises no incision or incisions that may or may not be parallel to one another.

In general, in other variants and configurations of the applying members 8, 18, 28, 38 already mentioned herein, may have rectilinear, double convex, half convex, half concave, double concave and concave convex side edges or any other shape possible.

All variants and configurations of the applying member 8, 18, 28, 38 can be manufactured essentially with the same manufacturing process. The proposed applying member 8, 18, 28, 38 can be produced in a simple manner, for example, in an injection molding process. The introduction of the incisions 11, 21, 31, 41 after preparation of the applying member 8, 18, 28, 38 using a cutting element or cutting tool can be performed comparatively easily and with little manufacturing effort.

Optionally, the manufacturing process may further comprise a flocking step provided that the applying member 8, 18, 28, 38 at least in part, to be flocked with a flocking material. The flocking preferably takes place before the incisions 11, 21, 31, 41 are made.

According to an embodiment of the present disclosure, at least a part and preferably all of the applicator head 10 can be made by molding, e.g. by injection-molding, e.g. in a material selected from the following list: thermoplastic materials; elastomers; thermoplastic elastomers; thermoplastic elastomer polyester such as HYTREL®, for example; nitrile rubber; silicone rubber; ethylene-propylene terpolymer rubber (EPDM); styrene-ethylene-butylene-styrene (SEBS); styrene-isoprene-styrene (SIS); polyurethane (PU); ethyl vinyl acetate (EVA); polyvinyl chloride (PVC); polyethylene (PE); polyethylene terephthalate (PET); polypropylene (PP); this list not being limiting.

In various embodiments (not shown), the tip of the applying member may be pointed, rounded or may have any other shape.

According to an aspect of the present disclosure, the applying members 8, 18, 28 are in form of a spatula, in alternate embodiments, however, the applying members 8, 18, 28 may not be spatula but includes a thin area comprising incisions.

According to an aspect of the present disclosure, the at least three parallel applicator tabs or the at least four parallel tabs are located on a limited area of the applying member, and wherein the limited area represent at most 60% of a total area of the applying member.

In the first embodiment, the wiper 206 serves to wipe off not only the excess cosmetic product attached to the applying member 8 but also the cosmetic product attached to the stem 20.

According to the first embodiment, the receptacle 200 and the cap 30 may be made of a rigid material like glass, metal, hard plastic or any other material known in the art. However, in alternate embodiments, the receptacle 200 and the cap 30 may be made of a flexible material like flexible polymeric material or any other material known in the art.

According to the first embodiment of the present disclosure, the stem 20 presents a cross-section that is circular, but it is not beyond the ambit of the present disclosure for this to be otherwise, in particular when the cross-section of the stem 20 is oval, elliptical or polygonal, e.g. square, triangular or rectangular. The stem 20 can be solid as shown, or, in a variant, it could be hollow.

When the stem 20 is not of circular cross-section, the cap 30 can possibly by fastened on the receptacle 200 by snap-fastening or by some other means, without turning relative to said receptacle 200. The wiper 206 can thus present a non-circular wiper orifice 215 of section that is complementary to the section of the stem 20.

According to an embodiment of the present disclosure, the applicator head 10 can be made, at least in part, from a material that is more flexible than a material from which the stem 20 is made.

According to first embodiment of the present disclosure, the applicator head 10 and the stem 20 are fitted together by a snap fitment. However, in alternate embodiments, the applicator head 10 and the stem 20 may be fit together by friction fit, by gluing, crimping, magnetic engagement and the like.

According to the first embodiment of the present disclosure, the stem 20 can have a longitudinal axis that is rectilinear as shown. However, in alternate embodiments, it could be curved.

The present disclosure is not limited to, the broadest in accordance with the basic idea disclosed herein. It should be interpreted as having a range. Skilled artisans may implement the pattern of the non-timely manner by combining, replacement of the disclosed embodiments shape, this would also do not depart from the scope of the invention. In addition, those skilled in the art may readily change or modifications to the disclosed embodiments, based on the present specification, such changes or modifications also belong to the scope of the present disclosure will be apparent.

It will be understood that the foregoing is only illustrative of the principles of the disclosure, and that various modifications can be made by those skilled in the art without departing from the scope and spirit of the disclosure. For example, the shapes and/or sizes of various components can be different from the shapes and sizes shown herein. As another example, the materials used for various components can be different from those mentioned specifically herein.

What is claimed is:

1. A cosmetic applicator for applying a cosmetic or a care product, the cosmetic applicator comprises:

an applicator head comprising an applying member and a shank member;

wherein the applying member is defined by a distal portion of the applicator head and the shank member is defined by a proximal portion of the applicator head;

wherein the applying member includes a proximal end and a distal end, and at least a main face;

wherein the at least one main face of the applying member is bounded by at least two opposing lateral edges;

wherein a width of the applying member is greater than a thickness of the applying member;

wherein the applying member further comprises at least four parallel incisions;

wherein the at least four parallel incisions extend from at least one of the at least two opposing lateral edges in a direction towards a central longitudinal axis of the applying member;

wherein each of the at least four parallel incisions extends across an entire width of said at least one of the two opposing lateral edges and through the thickness of the applying member, while only partially extending across a width of the at least one main face;

wherein the at least four parallel incisions form at least three parallel applicator tabs on the at least one main face of the applying member such that each of the at least three parallel applicator tabs includes a free end extending away from the central longitudinal axis of the applying member; and wherein all of the at least three parallel applicator tabs have same width.

2. The cosmetic applicator as claimed in claim 1, wherein the cosmetic applicator comprises a stem and a cap; and wherein the applicator head is retained at a distal end of the stem, and the cap is retained at a proximal end of the stem.

3. The cosmetic applicator as claimed in claim 1, wherein the applying member is elongated along a central longitudinal axis of the cosmetic applicator and is planar.

4. The cosmetic applicator as claimed in claim 1, wherein the applying member includes at least two opposing main faces; wherein the at least two opposing main faces comprises a first face and a second face; wherein the at least two opposing lateral edges includes a left side edge and a right side edge, and wherein the first face and the second face of the applying member are bounded by the left side edge and the right side edge of the applying member.

5. The cosmetic applicator as claimed in claim 4, wherein at least a portion of at least one of the left side edge and the right side edge is convexly curved along the longitudinal axis of the applying member.

6. The cosmetic applicator as claimed in claim 5, wherein the non-zero angle is selected from a range between 5° to 85°.

7. The cosmetic applicator as claimed in claim 4, wherein at least a portion of at least one of the left side edge and the right side edge is substantially rectilinear.

8. The cosmetic applicator as claimed in claim 4, wherein the at least four parallel incisions extend from one of the left side edge and the right side edge in a direction towards the central longitudinal axis of the applying member such that the at least four parallel incisions extend do not intersect the central longitudinal axis.

9. The cosmetic applicator as claimed in claim 1, wherein the at least four parallel incisions make a non-zero angle with the central longitudinal axis of the applying member.

10. The cosmetic applicator as claimed in claim 1, wherein a depth of each of the at least four parallel incisions is in a range of 1 mm-3 mm.

11. The cosmetic applicator as claimed in claim 1, wherein a depth of at least one of the at least four parallel incisions is different from depths of the rest of the at least four parallel incisions.

12. The cosmetic applicator as claimed in claim 1, wherein a width of each of the at least three parallel applicator tabs is at least two times greater than a width of an incision opening of each of the at least four parallel incisions.

13. The cosmetic applicator as claimed in claim 1, wherein widths of all the at least four parallel incisions are equal; wherein each of the at least four parallel incisions has a constant width; and wherein widths of the at least four parallel incisions are selected from a range of 0.1 mm-3 mm.

14. The cosmetic applicator as claimed in claim 1, wherein the applying member is at least partially flocked.

15. A cosmetic applicator for applying a cosmetic or a care product, the cosmetic applicator comprises:

an applicator head comprising an applying member and a shank member;

wherein the applying member is defined by a distal portion of the applicator head and the shank member is defined by a proximal portion of the applicator head;

wherein the applying member includes at least two main faces;

wherein the at least two main faces of the applying member is bounded by at least two opposing lateral edges;

wherein the applying member further comprises at least four parallel incisions;

wherein the at least four parallel incisions extend from at least one of the at least two opposing lateral edges along in a direction towards a central longitudinal axis of the applying member, and at least one incision extends from other of the at least two opposing lateral edges in a direction towards the central longitudinal axis of the applying member;

wherein each of the at least four parallel incisions extends across an entire width of said at least one of the two opposing lateral edges and through the thickness of the applying member, while only partially extending across widths of the at least two main faces;

wherein each of the at least four parallel incisions makes a non-zero angle with the central longitudinal axis of the applying member;

wherein the non-zero angle is an angle other than an orthogonal angle; and wherein the at least four parallel incisions forms at least three parallel applicator tabs on the applying member such that each of the at least three parallel applicator tabs includes a free end extending away from the central longitudinal axis of the applying member.

* * * * *